United States Patent [19]

Susse et al.

[11] 3,935,095

[45] Jan. 27, 1976

[54] STRONG FIELD MAGNETIC SEPARATORS

[75] Inventors: Wilhelm Susse, Krefeld; Heinz Alter, Rheinhausen, both of Germany

[73] Assignee: Fried. Krupp Gesellschaft mit beschrankter Haftung, Essen, Germany

[22] Filed: Apr. 30, 1973

[21] Appl. No.: 355,866

[30] Foreign Application Priority Data

May 5, 1972 Germany ..... 2222003

[52] U.S. Cl. ..... 209/222; 209/232

[51] Int. Cl.[2] ..... B03C 1/12

[58] Field of Search ..... 209/218, 232, 222, 223, 209/221; 210/222, 223; 336/58

[56] References Cited

UNITED STATES PATENTS

| | | | |
|---|---|---|---|
| 2,684,761 | 7/1954 | Downing | 209/218 |
| 3,279,602 | 10/1966 | Kottenstette | 210/222 X |
| 3,287,677 | 11/1966 | Mohr | 336/58 X |
| 3,289,836 | 12/1966 | Weston | 209/232 X |
| 3,294,237 | 12/1966 | Weston | 209/232 X |
| 3,326,374 | 6/1967 | Jones | 210/222 X |
| 3,375,925 | 4/1968 | Carpenter | 209/222 X |
| 3,503,504 | 3/1970 | Bannister | 209/223 |
| 3,507,026 | 3/1971 | Kolm | 210/222 |
| 3,581,898 | 6/1971 | Tyrell | 210/222 |

FOREIGN PATENTS OR APPLICATIONS

| | | | |
|---|---|---|---|
| 21,374 | 10/1904 | Sweden | 209/218 |
| 30,444 | 12/1911 | Sweden | 209/218 |
| 234,846 | 5/1911 | Germany | 209/222 |

*Primary Examiner*—Robert Halper
*Attorney, Agent, or Firm*—Walter Becker

[57] ABSTRACT

A high intensity field magnetic separator for separating materials of different magnetic properties, in which the materials to be separated from each other are during the movement of containers comprising induction poles and containing the materials to be separated passed through high intensity magnetic fields which are induced in the interior of coreless magnetic coils.

2 Claims, 5 Drawing Figures

STRONG FIELD MAGNETIC SEPARATORS

Figure 1:
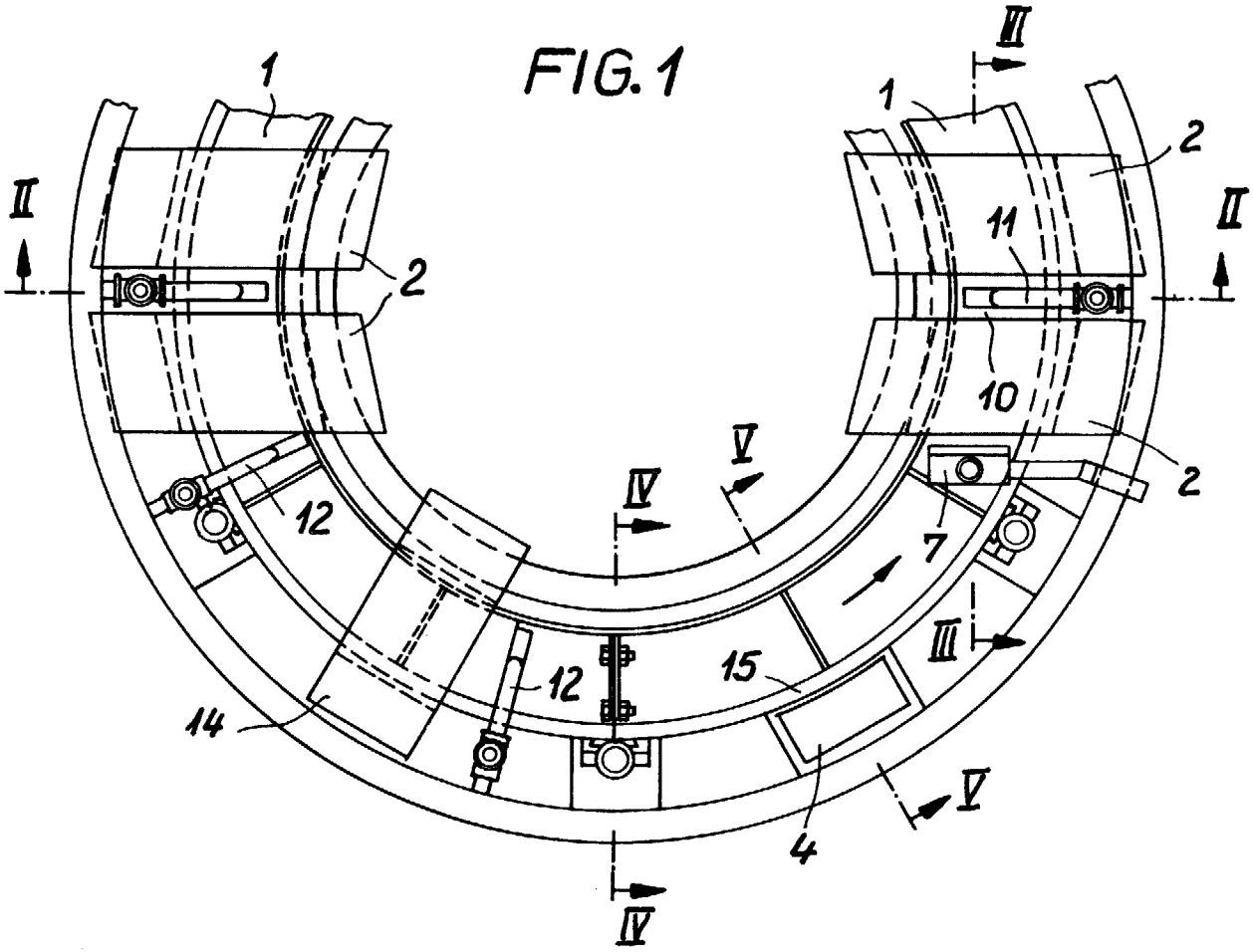
Figure 2:
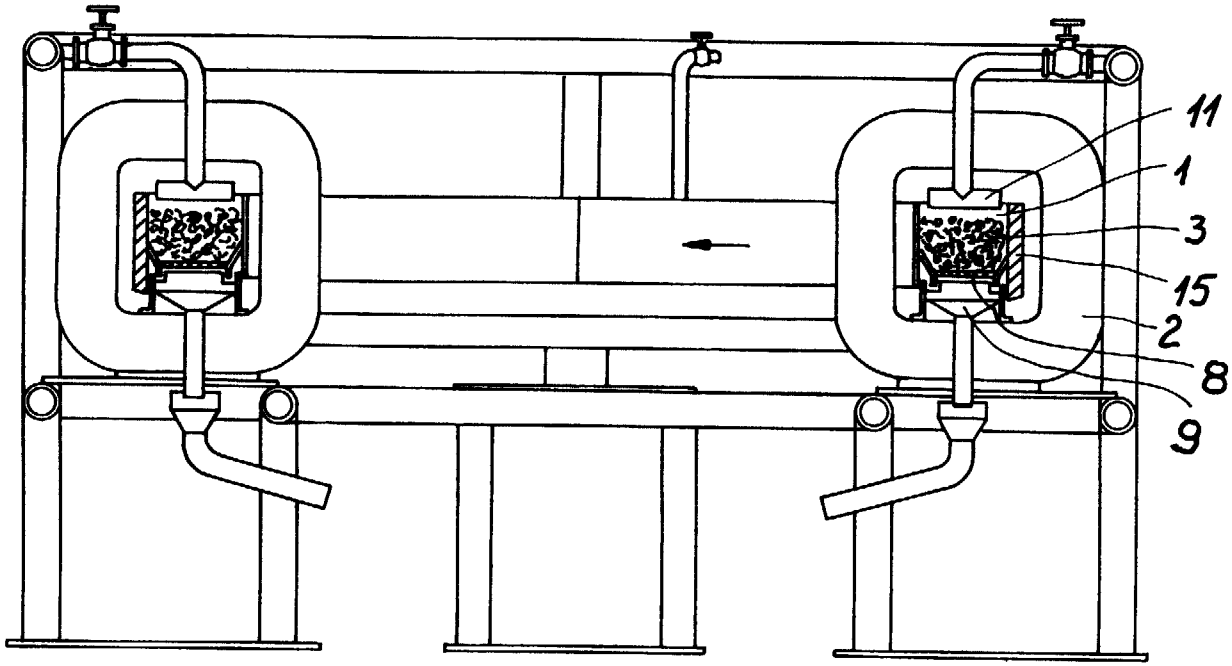
Figure 3:
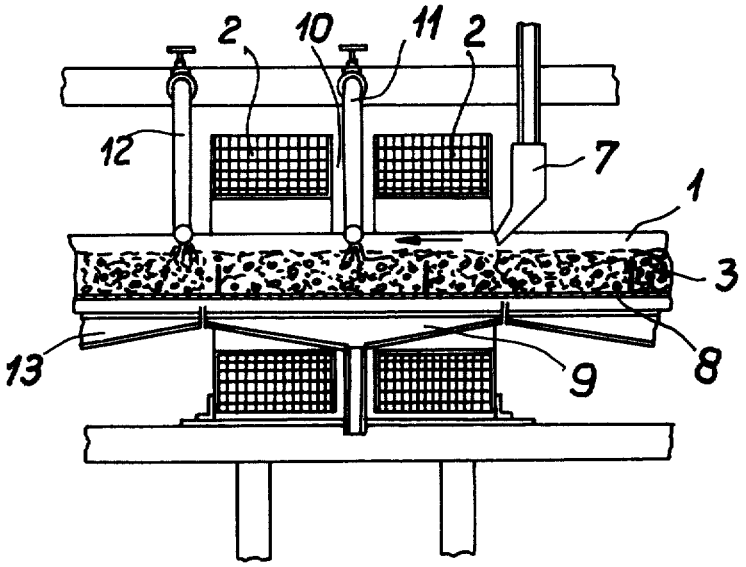
Figure 4:
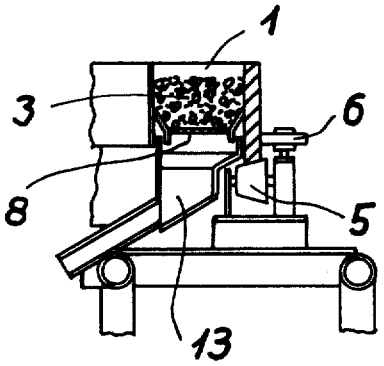
Figure 5:
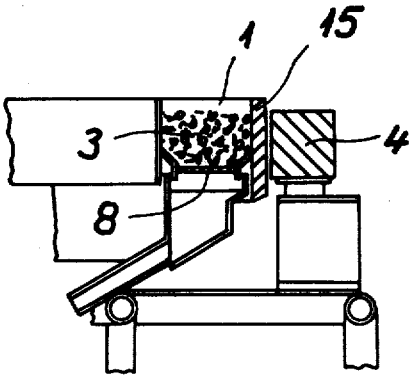

The present invention relates to a strong field magnetic separator for separating from each other materials of different magnetic properties, according to which the materials are by means of containers comprising induction poles passed through strong magnetic fields while the containers are in movement.

For separating materials of different magnetic properties, so-called magnetic separators are employed. In this connection, depending on the degree of the magnetic properties of the materials to be separated, various devices may be employed. For separating highly magnetic materials from weak magnetic materials and nonmagnetic materials, preferably weak field magnetic separators are employed which generally are designed as drum separators of various constructions. The separation of weak magnetic materials from non-magnetic materials, however, requires completely different devices. This is due to the fact that the, in this instance, required particularly high values for the product of magnetic field intensity and field intensity gradient cannot be ascertained with drum separators with which the separation of the respective materials is throughout effected in the stray field of the magnet system proper.

The heretofore known so-called strong field magnetic separators for separating weak magnetic materials from non-magnetic materials according to the dry or wet method have the drawback that they are heavy and expensive. With these separators, the magnetic field generated in magnetic coils is through large cross sections of ferromagnetic substances, preferably iron or iron containing alloys, conveyed to where it is to be used for separating the materials of different magnetizability from each other, namely between the pole shoes of electromagnets. In this connection differences between the various known magnetic separators exist only with regard to the way in which the magnetic field is guided relative to the space which is provided for separating the materials from each other. In order to obtain the required high values for the product of field intensity and gradient, this space is filled with materials of high permeability, in other words, with so-called induction poles which are so shaped and arranged that at their contact points or at their points of smallest distance, high field line densities will occur. For a continually working separating device, the guiding of a container through the space or chamber is necessary. Inasmuch as such guidance can be effected only transverse to the lines of force of the magnetic field located between the pole shoes of the electromagnets, it will be appreciated that naturally great forces act from the pole shoes onto the container. All devices of this type, therefore, have in common that for guiding the magnetic lines of force, considerable masses of iron are required and that for receiving the power effect upon the container, particularly strong bearings and devices are necessary.

It is, therefore, an object of the present invention to provide a strong field magnetic separator of the above described general character, which will be free from the above outlined drawbacks.

This object and other objects and advantages of the invention will appear more clearly from the following specification in connection with the accompanying drawings, in which:

FIG. 1 is a portion of a top view of a magnetic separator according to the invention.

FIGS. 2—5 respectively illustrate cross sections through the lines II — II, III — III, IV — IV and V — V of FIG. 1.

The strong field magnetic separator for separating materials of different magnetic properties, in which the materials are passed through containers comprising induction poles while the containers are moved through strong magnetic fields, is according to the present invention characterized in that the path of movement of the containers extends through magnetic fields which are induced in the interior of core-less magnetic coils.

The present invention is based on the finding that when introducing a container with induction poles into a core-less magnetic coil generating a magnetic field, there will be generated in the core-less magnetic coil high values for the product of magnetic field intensity and gradient. The forces acting upon the container are minor inasmuch as the magnetic forces primarily balance each other between the induction poles in the container. In this way large iron masses for conveying the magnetic field lines of force as well as the heavy design for mounting the containers will be superfluous.

The containers may, as known per se, be linked to an endless chain or may be designed as chambers of a circular ring of U-shaped cross section and may be rotatable about a vertical central axis. In the last mentioned instance, it would, however, not be possible to provide a definite central and rotary shaft to which the ring, similar to heretofore known strong field magnetic separators, could be connected by spokes. The reason for this consists in that the ring itself is passed through the magnetic coils. The ring itself thus has to be supported by supporting and guiding rollers or has to be guided in its path of movement.

Referring now to the drawings in detail, a circular ring 1 of U-shaped cross section forms a container of non-magnetic material. This container is moved through the magnetic field which is induced in the interior of a core-less coil 2 passed through by direct current. Induction poles 3 located in the circular container are magnetized by the lines of force of the magnetic field so that at their points of contact or points which have the least distance from each other there will be generated a high field line density, which means high yields for the product of magnetic field intensity and gradient. The circular ring is rotated about its vertical central axis from a circumferential point outside the coil 2 by any desired driving element 4. Due to the supporting rollers 5, the ring is guided from below, and guiding rollers 6 see to it that the ring remains also laterally in its intended track and is not deviated by minor lateral forces within the magnetic coil 2. The supporting rollers 5 may be so arranged that in view of their conical shape they will bring about a self-stabilizing movement of the ring.

The feeding of the materials to be separated is effected, in the direction of movement of the ring shortly prior to the ring entering the coil 2, through a charging device 7 which sees to it that the material is uniformly distributed over the width of the ring. If the materials involved represent a suspension in a liquid, the charging device may, for instance, be designed as a slotted pipe or as an overflow trough. For dry materials, the charging device may consist, for instance, of a vibrotrough.

There will now be described the operation of the separation of materials of different magnetic properties for a suspension.

After supplying the suspension, which henceforth may also be called the sludge, the same will in view of the advancing movement of the ring enter the interior of the magnetic coil 2 and under the influence of the force of gravity will pass between the induction poles 3 to the bottom side of the ring which has a U-shaped cross section. This bottom side is, preferably by means of an inserted sifting bottom, designed so as to be permeable. The bottom may also be perforated in a different manner. In this way a portion of the liquid will flow off with the non-magnetic components and will pass through a chute 9 located between the container bottom and the coil 2.

The withdrawal of the sludge may be effected in the direction and also opposite to the direction of movement of ring 1, but it may also be effected through a gap 10 or an opening in the magnetic coil 2. While the ring 1 in coil 2 continues its movement, it passes into the region of a sprinkling device 11 which may be similar to the charging device 7. Here, by the addition of liquid low in solid substances, the magnetic substances adhering to the induction poles 3 are washed off and the induction poles are, as a result thereof, freed from residues of still adhering weaker or non-magnetic materials. The liquid which in this way is enriched with solid materials flows between the induction poles 3, leaves the ring 1 through the sifting bottom 8 and is discharged through chute 9 from the inner space of the coil 2. If necessary, the first sprinkling device 11 may be followed by one or more sprinkling devices. The serially last sprinkling operation must be finished or completed when ring 1 during its movement through coil 2 comes into the region of the magnetic lines of force which are no longer dense enough to form at the induction poles 3 such values for the product of field intensity and gradient as they are required for an adherance of the substance of higher magnetizability. This may be the case inside of as well as outside of the coil.

During its further movement, ring 1 gradually leaves the range of the lines of force, and after the product of field intensity and gradient has fallen below the limit value for the product of field intensity and gradient of the magnetic substances adhering up to this time to the induction poles 3, these substances may be washed off by an additional sprinkling device 12. The washed off substances pass through the permeable bottom 8 and while thus leaving the container are conveyed through a further chute 13. Thus, the induction poles 3 are again free and ready for a further separating operation.

Under some circumstances it may be necessary to effect a temporary de-magnetizing of the induction poles 3. To this end, when viewing in the direction of movement of the ring, a demagnetizing coil 14 passed through by an alternating current may be arranged behind the magnetic coil 2. If in the path of ring 1 there are provided at least two magnetic coils 2, it is possible therebetween to obtain a de-magnetizing by arranging the magnetic coils in their magnetizing direction with regard to the ring in an opposite direction, which means in such a way that two successive magnetic coils face each other with the same poles.

The drive of ring 1 may be effected in customary manner by conveying a mechanical force through a driving means onto the ring from the circumference thereof. By correspondingly designing the container, the wall 15 thereof or an element arranged on the wall may be employed as counter pole of a linear motor so that a frictionless power transmission will be realized.

It is, of course, to be understood that the present invention is, by no means, limited to the specific showing in the drawings but also comprises any modifications within the scope of the appended claims.

What we claim is:

1. A strong field magnetic separator for separating materials of different weak magnetic properties from each other, which includes in combination: a plurality of coreless magnetic coils operable to induce high intensity magnetic fields in the space within said coreless magnetic coils, said magnetic coils including an even number of coreless magnetic coils each two successive magnetic coils having poles of the same polarity facing each other, container means including induction poles and being movable within the space surrounded by said coreless magnetic coils, conveying means for conveying materials to be separated from each other into said container means, means for withdrawing separated materials of different magnetic properties, said container means including a plurality of containers respectively forming chambers of a circular ring rotatable about its vertical central axis, and driving means operatively connected directly to the periphery of said ring.

2. A strong magnetic separator for separating materials of different magnetic properties from each other, which includes in combination: a plurality of coreless magnetic coils operable to induce high intensity magnetic fields in the space within said coreless magnetic coils, container means comprising a channel-shaped ring of non-magnetic material having an outer side wall and a perforated bottom and mounted to rotate about a vertical axis, said ring being surrounded by said coils so as to pass through said space within said magnetic coils, induction poles of magnetizable material closely spaced in said channel-shaped ring, conveying means for conveying materials to be separated from each other into said container means, means for withdrawing separated materials of different magnetic properties by passing non-magnetic material through perforated bottom of said container means in a magnetic field of said coils and passing magnetizable material through said perforated bottom beyond a magnetic field, said container means including a plurality of containers respectively forming chambers of said channel-shaped ring, driving means operatively connected to said ring to rotate said ring about the vertical axis, and guiding and supporting rollers including lateral rollers in engagement with said outer side wall to resist outward movement of said ring.

* * * * *